United States Patent [19]

DelPercio et al.

[11] 4,097,721

[45] Jun. 27, 1978

[54] MULTIPLE UNIT ELECTRICAL BASEBOARD HEATER

[75] Inventors: Michael J. DelPercio, Imperial; Wayne E. Krejci, St. Louis, both of Mo.

[73] Assignee: Intertherm, Inc., St. Louis, Mo.

[21] Appl. No.: 764,827

[22] Filed: Feb. 2, 1977

[51] Int. Cl.[2] ..... F24H 9/04; H05B 3/06

[52] U.S. Cl. ..... 219/366; 219/363; 219/367; 219/382; 219/537

[58] Field of Search ..... 219/341, 342, 344, 350–352, 219/363, 364, 365–368, 376, 382, 537

[56] References Cited

U.S. PATENT DOCUMENTS

| | | | |
|---|---|---|---|
| 1,398,168 | 11/1921 | Bakstad | 219/342 |
| 2,405,072 | 6/1946 | Trilling et al. | 219/366 |
| 2,606,993 | 8/1952 | Geoffrion | 219/342 |
| 3,448,243 | 6/1969 | Ripple | 219/366 |
| 3,469,075 | 9/1969 | Barbier | 219/341 |
| 3,470,352 | 9/1969 | McKay et al. | 219/367 |
| 3,551,642 | 12/1970 | Knoll | 219/342 |
| 3,631,525 | 12/1971 | Brasch | 219/364 |

FOREIGN PATENT DOCUMENTS

| | | | |
|---|---|---|---|
| 664,752 | 6/1963 | Canada | 219/342 |
| 867,964 | 4/1971 | Canada | 219/363 |

*Primary Examiner*—J. V. Truhe
*Assistant Examiner*—Bernard Roskoski

[57] ABSTRACT

An electrical baseboard heater having multiple elongated electrical heating units aligned parallel to each other may be field wired at either of its ends. A preassembled heating assembly, when secured onto the base of the baseboard heater cabinet, forms a wiring raceway for return wiring from the nonadjacent terminals of the heating units and for secondary power supply wiring to the other end of the cabinet.

5 Claims, 4 Drawing Figures

MULTIPLE UNIT ELECTRICAL BASEBOARD HEATER

BACKGROUND OF THE INVENTION

This invention relates to elongated electrical resistance heaters such as are commonly used for baseboard installation; and particularly to that type shown in U.S. Pat. No. 3,469,075. That patent shows a sealed circulating water system including an elongated reservoir tube containing a resistance heating element whose terminals project at both ends.

According to the best of applicants' knowledge, no electric baseboard heater in the prior art utilized more than one of such elongated heating units aligned parallel to each other.

To provide a plurality of such units involves obvious wiring problems, particularly where it is desired to adapt the heater for field wiring at either end.

SUMMARY OF THE INVENTION

A purpose of the present invention is to provide for structural assembly and wiring of a plurality of electrical heating units positioned parallel to each other in a baseboard-type electric heater. A second purpose is to provide an electric heater which may be field wired at either end upon installation. Another purpose is to allow parallel wiring of several such heaters to a single power supply.

Briefly summarizing, a heater constructed under the present invention utilizes a plurality of elongated electrical heating units of the type having an electrical terminal at each end. The several heating units are mounted on an inverted channel and parallel wired to a terminal block at its end. Wiring from the other end of the heating units to the terminal block is along the under side of the inverted channel. The terminal block may be supplied with power from connectors passed through a heat shield adjacent to the terminal block or, alternatively, from connectors along the under side of the inverted channel and passed through another heat shield on the opposite end. This permits the heater to be field wired from either end.

This assembly may be secured to the bottom panel of a sheet steel heater cabinet having a lower edge air inlet and a top air outlet. Thus a wiring raceway is provided between the under side of the inverted channel and the upper surface of the cabinet base panel.

The present invention also provides a new use for conventional elongated heating units of the type described. This new use includes the steps of creating a wired sub-assembly by mounting a plurality of such heating units parallel to each other on an inverted channel, prewiring the units onto an integrated assembly to which power may be supplied at either end, with all return wiring on the under side of the channel, and installing the sub-assembly onto the bottom panel of a cabinet to provide therebetween a wiring raceway.

DESCRIPTION OF THE PREFERRED EMBODIMENT

Figure 1:
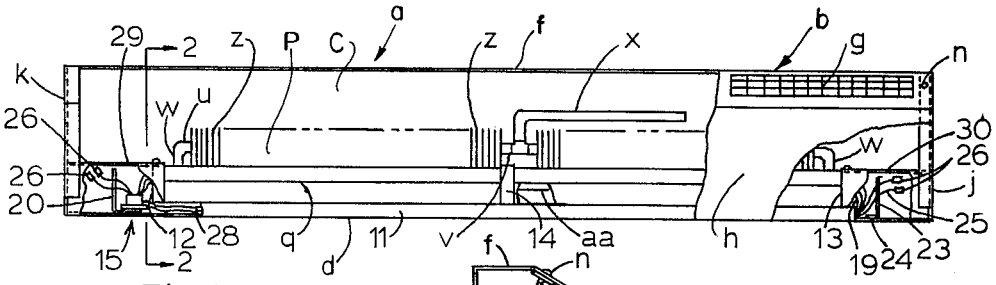
FIG. 1 is a front elevation of the preferred embodiment of a multiple unit baseboard heater embodying the present invention. The cabinet heater front is cut away to reveal its interior.
Figure 2:
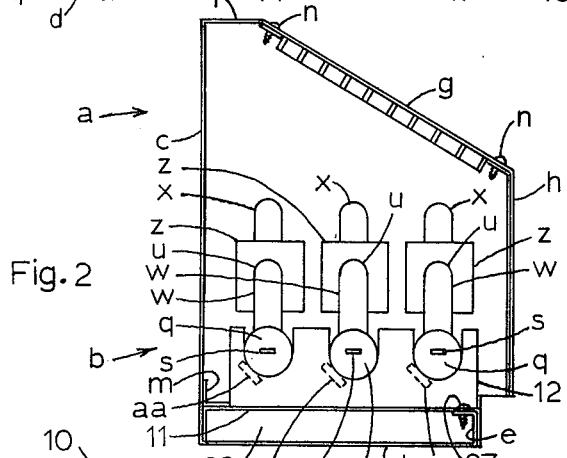
FIG. 2 is a section of the heater of FIG. 1 taken along line 2—2 thereof.

A preferred embodiment of the multiple baseboard heater is shown in the included drawings. Referring to FIG. 1, a typical elongated cabinet enclosure, generally designated *a*, has a sheet metal body *b* which includes a rear panel portion *c*, a bottom panel portion *d*, and a top panel portion *f*. The bottom panel portion *d* has a shallow front flange *e* whose upper margin is turned rearward as shown in FIG. 2. The rear panel portion *c* has an angle *m* secured on its inner surface which projects forward at a level slightly above that of the upper margin of the front flange *e*. The cabinet enclosure includes a removable sloping top grill panel *g* and a removable front panel *h* having an air inlet gap at its lower edge. The removable top panel *g* and removable front panel *h* may be secured in place by screws *n*. The cabinet enclosure *a* also has a right end panel *j* and a left end panel *k*.

The heater illustrated utilizes three conventional elongated electrical heating units generally designated *p*. Each heating unit *p* has a sealed system of tubing including a substantially horizontal reservoir tube *q* in which is enclosed an electrical resistance heater *r* whose left electrical terminal *s* projects outward through the left closed end of the reservoir tube *q* and whose right electrical terminal *t* projects outward through its right end. An upper parallel flow tube *u* is connected to the reservoir tube *q* by a center riser tube *v* and a return tube *w* at each end. A center pressure relief tube *x* is connected to the upper parallel flow tube *u* on its upper side. The reservoir tube *q*, flow tube *u*, riser tube *v* and return tube *w* together form a chamber to contain a water-antifreeze solution *y*. The upper horizontal flow tube *u* has heat-exchange fins *z* on its exterior surface. A conventional safety switch *aa* is secured to the underside of the horizontal reservoir tube *q* near its center point.

In the present invention, the three heater units are utilized in a heating asssembly 10, wired and assembled on an inverted channel 11. An upright left support 12 is provided at the left end of the inverted channel 11, an upright right support 13 is provided at the right end of the inverted channel 11, and an upright center support 14 is provided at the center of the inverted channel 11. The supports 12, 13, 14 form three parallel saddles in which the three electrical heating units *p* are positioned parallel to each other.

Figure 3:
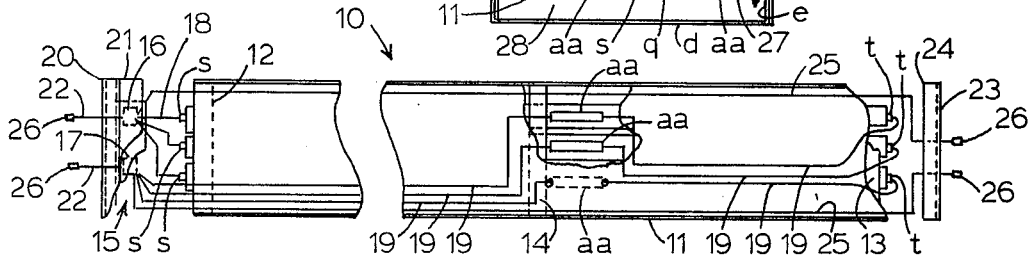
FIG. 3 is a bottom view of the heating assembly. The inverted channel is partially cut away to reveal connections to the safety limit switches and to the right terminals of the unit heaters.

A terminal block 15 having a first connector 16 and a second connector 17 is adjacent to the left end of the inverted channel. Parallel wiring connections 18 are made from the first connector 16 to the left electric terminals *s* of the heating units *p*. As shown in FIG. 3, return parallel wiring connections 19 from the right electric terminals *t* of the heating units *p* are made along the underside of the inverted channel 11, to the center of the inverted channel 11, passing up through the inverted channel 11 to make series connections with the safety limit switch *aa*, then passing down through and continuing along the underside of the inverted channel 11, and connecting to the second connector 17 of the terminal block 15.

Figure 4:
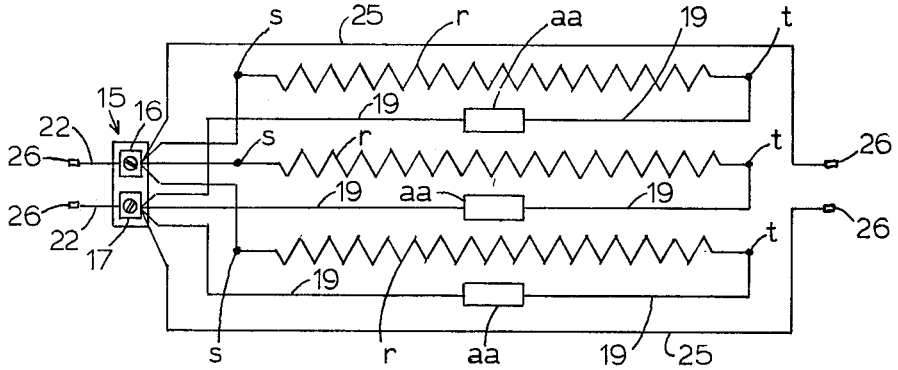
FIG. 4 is a wiring diagram of the preferred embodiment of the multiple unit baseboard heater.

At the left of the terminal block 15 is a left heat shield 20 with a lower flange 21, the terminal block 15 being mounted thereon. A pair of connectors which serve as first line power supply wiring 22 pass through grommets in the left heat shield 20 as they extend from the terminal block 15 to the space on the other side of the left heat shield 20. A right heat shield 23 having a lower flange 24 is provided at the right of the inverted channel 11. Second line power supply wiring 25 from the terminal block 15 extends along the underside of the inverted channel 11 and passes through grommets in the right heat shield 23 to the space on its other side. The ends of the first line power supply wiring 22 and the second line power supply wiring 25 outside of the heat shields 20, 23 are provided with end caps 26, which may be wiring nuts. FIG. 4 is a diagram of the wiring so described.

To complete assembly of the electrical heater, the heater assembly 10 on the inverted channel 11 is mounted in the cabinet enclosure *a* by sliding the inverted channel 11 in the cabinet enclosure *a* under the angle *m* and resting the forward inner side of the channel 11 upon and against the front flange *e* of the bottom panel portion *d*. The assembly is then secured by screws 27 through the upper margin of the front flange *e* and the top forward edge of the inverted channel 11. A raceway 28 is thereby made up by the inverted channel 11 and the sheet metal bottom panel portion *d*.

In final assembly, a removable left junction box cover 29 is attached to the upper surface of the left support 12 and extends to the adjacent end of the cabinet enclosure *a*. A right junction box cover 30 is similarly attached to the right support 13. The lower surfaces of the junction box covers 29, 30 engaged downwardly on the ends of the reservoir tubes *q* of the heating units *p* to hold them in place.

The present invention includes the process of assembling an electrical baseboard heater. A heating assembly is created by mounting three electrical heating units on an inverted channel and wiring a series circuit, including a safety limit switch, from each of the heating units to a terminal block having two connectors, thus connecting the three heating units in parallel. The heating assembly is completed by wiring from the terminal block through heat shields adjacent to each end of the channel and affixing removable caps to the ends of those wires. Construction of the baseboard heater is completed by securing the heating assembly including the channel 11, left heat shield 20 with terminal block 15, and right heat shield 23, onto the bottom panel of a baseboard heater cabinet. This final step forms a wiring raceway beneath the channel in which the wiring has already been made.

The present invention also includes the process of installation of the electrical heater, which is accomplished by securing the electrical heater against a wall, removing the end caps 26 at that end of the heater to which the power is to be supplied, and field wiring to a power supply. The electrical heater may be field wired at either end. The end caps 26 show where the wiring should be made and prevent short circuits at the unused end.

As an unusual feature of the invention, more than one of the present electrical heaters may be wired in parallel when placed end to end by supplying power directly to one of the electrical heaters and interwiring subsequent heaters end to end as desied. Current regulations may be construed to limit the number of heaters which may be wired to two.

The wiring raceway 28 protects the interior wiring from contacting the heater units and further provides strength to the heater cabinet *a*.

Where it is known in advance that field wiring will be made at the left end of the heater cabinet, as a matter of design choice, the heat shield 23 and the second line power supply wiring 25 may be omitted. This would provide an electrical heater which could be wired at one end only. Even in this case, the invention would include the raceway 28 for return wiring from the right electrical terminals *t* to the terminal block 15.

We claim:

1. An electrical heating assembly for installation in an elongated cabinet enclosure of the type having a bottom wall, comprising an inverted channel, upright support means mounted on said inverted channel, a plurality of elongated electrical heating units each of the type having an electrical terminal at each end, said heating units being horizontally supported by said upright support means parallel to each other and with their terminals aligned, a first heat shield outwardly adjacent to one end of said inverted channel and positioned substantially transverse thereto and spaced outwardly from the aligned terminals of said heating units at one end thereof, a second heat shield outwardly adjacent to the other end of said inverted channel and positioned substantially transverse thereto and spaced outwardly from the aligned terminals of said heating units, terminal block connector means supported by said first heat shield in position between said first heat shield and said inverted channel and having two connectors, parallel circuit means having connections from one connector of said terminal block connector means to the adjacent electrical terminals of said heating units and having return connections from the non-adjacent electrical terminals of said heating units along the underside of said inverted channel to the other connector of said terminal block connector means, said return connections including series safety limit switch means associated with each of said heating units, said connections serving as temporary supports, by said channel, for said terminal block connector means, first line power supply wiring extending from said terminal block connector means and mounting and extending through said first heat shield to a first pair of connector ends outwardly thereof, and second line power supply wiring extending from said terminal block connector means along the underside of the inverted channel and mounting and extending through said second heat shield to a second pair of connector ends outwardly thereof, whereby said inverted channel, heat shields, and terminal block connector means of said assembly may each be secured to such bottom wall of such cabinet, the inverted channel and cabinet bottom together forming a wiring raceway, and such cabinet containing said assembly may be field wired to either of said pairs of connector ends.

2. An electrical heater of the type having an elongated cabinet, comprising

A. an elongated cabinet enclosure having a rear panel portion, a bottom panel portion, removable front panel means providing an air inlet at its lower edge, top means providing an air outlet, a right end panel, and a left end panel, in combination with B. a heating assembly preassembled and prewired for placement in said elongated cabinet enclosure, said assembly having an inverted channel adapted to fit and secured onto said bottom panel portion, upright support means mounted on said inverted channel, a plurality of elongated electrical heating units each of the type having an electrical terminal at each end, said heating units being supported horizontally by said upright support means parallel to each other and with their terminals aligned, a heat shield adjacent to one end of said inverted channel and positioned substantially transverse thereto and spaced outwardly from the aligned terminals of said heating units at one end thereof, terminal block connector means positioned between said first heat shield and said inverted channel and having two connectors, parallel circuit means having connections from one connector of said terminal block connector means to the adjacent electrical terminals of said heating units and having return connections from the non-adjacent electrical terminals of said heating units along the underside of said inverted channel to the other connector of said terminal block connector means, said return connection including series safety limit switch means associated with each of said heating units, line power supply wiring from said terminal block connector means through said heat shield, and having means to connect field wiring outwardly thereof, together with C. means to secure said inverted channel and said heat shields and terminal block connector means onto said bottom panel portion, whereby said bottom panel portion and said inverted channel together form a wiring raceway, and for field wiring access need be had only to the means to connect outwardly of the heat shield.

3. An electrical heater as defined in claim 2, said heating assembly further having a second heat shield adjacent to the other end of said inverted channel and positioned substantially transverse thereto and spaced outwardly from the aligned terminals of said heating units, and second line power supply wiring from said terminal block connector means along the under side of said channel and through said second heat shield whereby the electrical heater may be field wired at either end.

4. The method of assembling a baseboard heater having a plurality of elongated electric heating units of the type having an electrical terminal at each end, the process comprising the steps of A. creating a heating assembly by mounting such electrical heating units on an inverted channel parallel to each other and with their terminals aligned, wiring a series circuit for each of such heating units leading from a terminal block connector adjacent to one terminal of such heating units and returning from the other end along the under side of such inverted channel, thence upward through the channel to a safety limit switch in contact with said heating unit and thence downward through and along the under side of such channel to a second terminal of such terminal block, connecting the said series circuits in parallel with each other at said terminal block, wiring a first set of connectors from such terminal block through a heat shield adjacent to one end of such parallel aligned heating units to a point outwardly thereof, wiring a second set of connectors from said terminal block along the under side of said inverted channel and then through a heat shield outwardly adjacent to the other end of said heating units and then B. securing such heating assembly, including said inverted channel, heat shields and terminal block, for support on the bottom panel of an elongated sheet metal cabinet having a lower edge air inlet and a top air outlet, whereby to provide a complete baseboard heater.

5. The process defined in claim 4 together with the step of affixing on the end of each said connector projecting beyond each said heat shield a removable cap, and the subsequent steps of setting the baseboard heater so constructed in position for use, removing the connector caps outward of one of such heat shield and field wiring to a power supply the connectors whose caps are so removed.

* * * * *